US005529613A

United States Patent [19]

Yavnieli

[11] Patent Number: 5,529,613

[45] Date of Patent: Jun. 25, 1996

[54] AIR IONIZATION DEVICE

[75] Inventor: Mordechai Yavnieli, Ra'anana, Israel

[73] Assignee: Amron Ltd., Tel Aviv, Israel

[21] Appl. No.: 243,144

[22] Filed: May 16, 1994

[30] Foreign Application Priority Data

May 18, 1993 [IL] Israel ..... 105731
Jan. 5, 1994 [IL] Israel ..... 108275

[51] Int. Cl.[6] ..... B03C 3/12

[52] U.S. Cl. ..... 96/63; 55/360; 96/68; 96/96; 361/226; 361/233

[58] Field of Search ..... 96/96, 97, 63, 96/55, 75, 17, 66, 68; 95/70, 79, 57; 55/360; 361/226, 233

[56] References Cited

U.S. PATENT DOCUMENTS 4,072,477 2/1978 Hanson et al. ..... 96/75 X
4,244,710 1/1981 Burger ..... 96/97 X
5,055,115 10/1991 Yikai et al. ..... 96/97 X
5,290,343 3/1994 Morita et al. ..... 96/96 X
5,368,635 11/1994 Yamamoto ..... 96/63 X

FOREIGN PATENT DOCUMENTS 67389 3/1958 France ..... 96/96
48817 11/1977 Israel .
4-363157 12/1992 Japan ..... 96/96

*Primary Examiner*—Richard L. Chiesa
*Attorney, Agent, or Firm*—Nixon & Vanderhye

[57] ABSTRACT

Ionization apparatus including a housing, a high voltage source having a high voltage terminal and a ground return terminal, an ionization electrode inside the housing electrically connected to the high voltage terminal and a grounding wire mounted to the exterior surface of the housing and electrically connected to the ground return terminal.

16 Claims, 4 Drawing Sheets

AIR IONIZATION DEVICE

FIELD OF THE INVENTION

The present invention relates to ionization devices that extract indoor air pollutants by producing negative ions and especially to grounding used in conjunction with such devices.

BACKGROUND OF THE INVENTION

Ionization devices are known for improving the air quality of indoor environments caused by two types of pollution. One type of pollution is ion depletion which occurs in tightly sealed spaces in the absence of fresh air flow. The second type of pollution is solid pollution such as cigarette smoke, dust, soot, industrial pollutants, pollen and smog. Negative ions provided by ionization devices generally reduce the discomfort of a highly pollinated atmosphere or an atmosphere having a deficiency of negative ions or a surplus of positive ions. Breathing in positive ions tends to lower the oxygen level of the blood and increases the accumulation of serotonin, a neurohormone capable of inducing adverse biological effects. Ionized air has been shown to reduce serotonin levels as well as to substantially reduce the amount of bacteria in the air.

Conventional ionization devices include an ionization electrode coupled to a source of high voltage. The ionization electrode is generally a conductive needle or a thin wire. Airborne particles which are to be precipitated from the air by electrostatic attraction to the ground are charged with extra electrons by the ionization electrode. This charging ionizes the airborne particles and removes some of the pollutants from the air.

Israel Patent 48817 describes a negative air ionization device employing a tubular shield to protect a conductive needle from accidental direct contact. In addition, this ionization device includes a grounding wire touching the ionization electrode. The grounding wire reduces an electrostatic field that forms in the vicinity of the shield so that a controlled flow of ions is produced.

SUMMARY OF THE INVENTION

It is an object of the present invention to provide an improved ionization device having an improved mechanism for ionizing air under conditions of low humidity.

In general, air ionization devices comprise a high voltage ionizer enclosed in a non-conductive housing. The present inventors have found that static electric charges accumulate on the outer nonconducting surface of the housing of negative air ionization devices. These charges have the same polarity as those being produced by the ionization device and, thus, the accumulated charges generate an electrostatic field which inhibits the creation of new ions and thus reduces the ion-producing efficiency of the ionization device.

The present inventors have observed that when the humidity level of the air is normal or high, the surface resistance of the outer surface of the housing of the ionization device is reduced and grounding of the interior of the housing is sufficient to provide adequate discharge of the outer surface. It is believed that the conductivity of the moisture in the air assists in discharging the charges accumulated on the outer surface of the housing by conducting the charges to the internal grounding element.

However, the present inventors have found that when the humidity level is low, the surface conductivity is insufficient and the charges remain on the outer surface. Ion production can be impeded unless these charges are removed from the outer surface of the housing, despite the fact that the housing is relatively far from the ionizer.

An improved ionization device is provided by the present invention that preferably comprises a conducting grounding wire connected, on one end thereof, to an internal grounding return terminal and having the other end thereof electrically connected to the outer surface of the housing of the ionization device.

Surprisingly, the present inventors have observed that the high ion producing efficiency of apparatus according to the present invention is maintained, under conditions of low humidity, even when the grounding wire is connected to the exterior surface of the housing by a grounding element which is attached only to a very small area of the exterior surface. It is believed that this externally mounted grounding element is sufficient to discharge charges built up on the outer surface of the housing.

Experiments have shown that when the humidity level of the air is low, the air purification efficiency of ionization devices constructed and operative in accordance with the present invention is up to 150 percent higher than the efficiency of conventional ionization devices without such grounding.

BRIEF DESCRIPTION OF THE DRAWINGS

The present invention will be understood and appreciated more fully from the following description taken in conjunction with the drawings in which.

DETAILED DESCRIPTION OF THE PREFERRED EMBODIMENT

Figure 1:
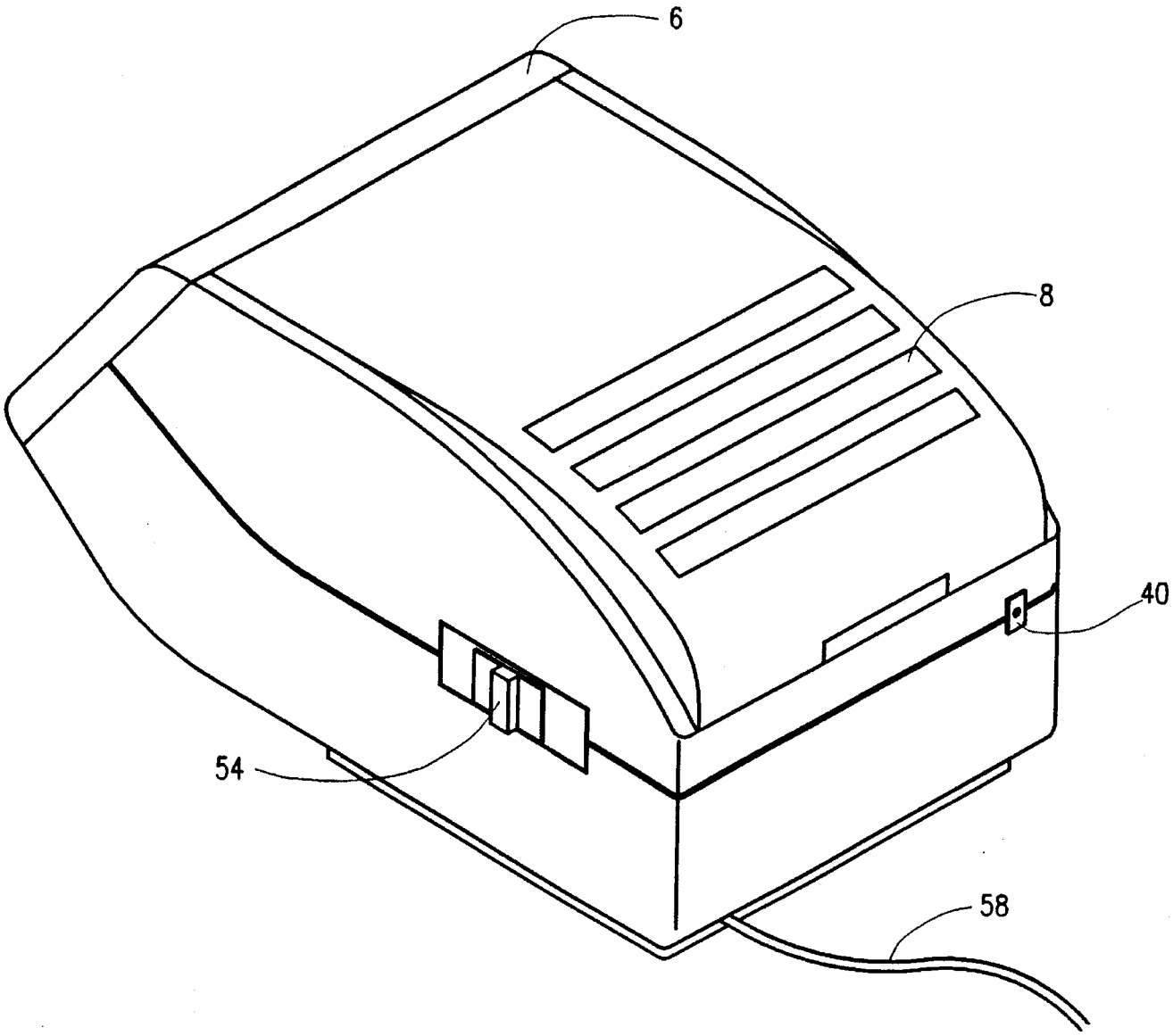
FIG. 1 is a perspective drawing of an ionization device in accordance with a preferred embodiment of the present invention.
Figure 2:
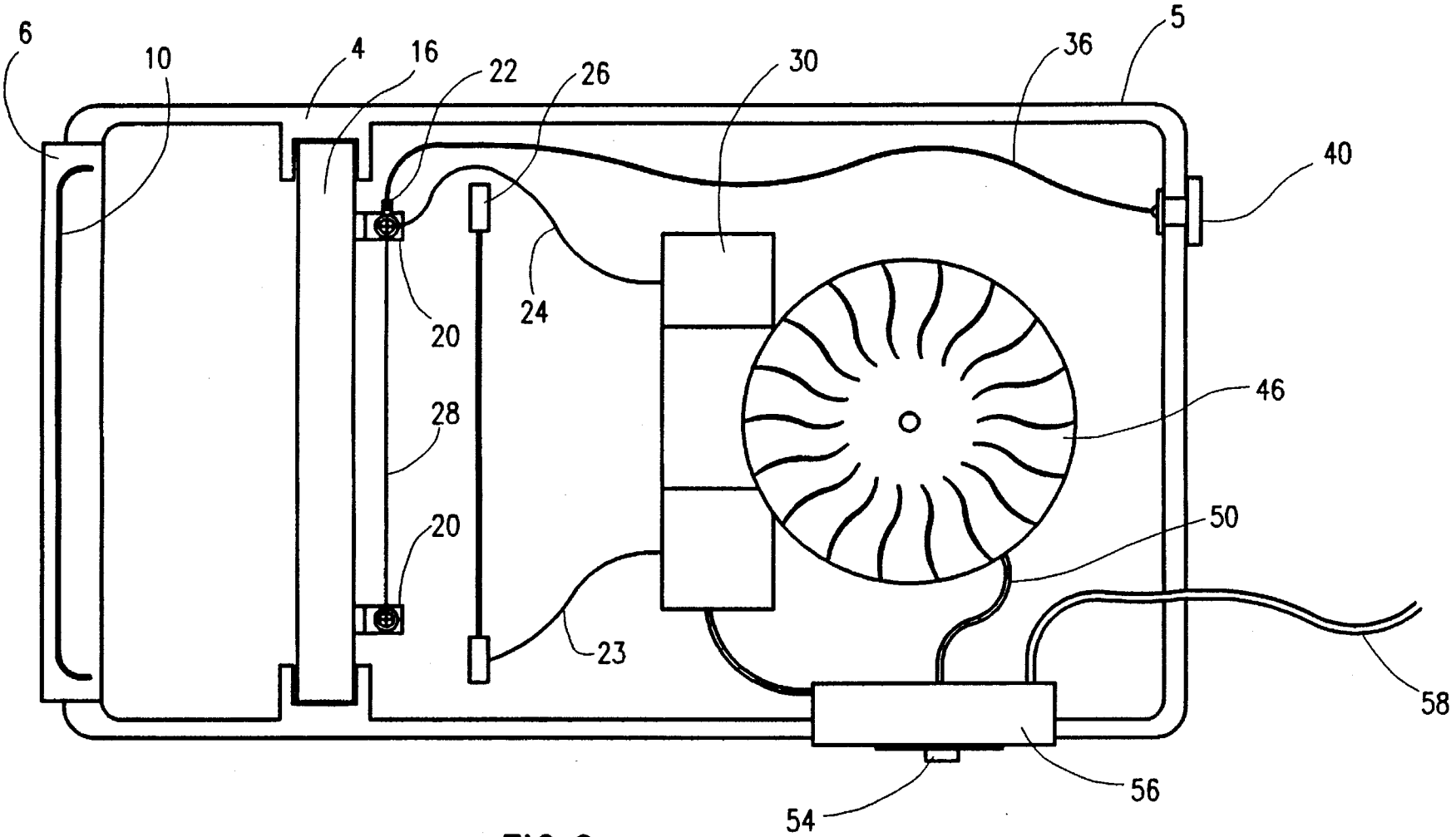
FIG. 2 is a schematic cross-section illustration of the ionization device in FIG. 1.

Reference is now made to FIG. 1 which shows a perspective view of an ionization device in accordance with a preferred embodiment of the present invention and to FIG. 2 which shows the internal construction of the ionization device. The ionization device preferably includes a box-like, nonconducting, housing 4. During operation of the ionization device, air is circulated through housing 4 by any suitable air circulating means. In a preferred embodiment of the invention, the air circulating means includes an electric fan 46 which is mounted inside housing 4. Air is preferably drawn into housing 4 by electric fan 46 through an upper grill 8 on the top surface of housing 4. Fan 46 is preferably powered by AC voltage supplied from a wall plug through a power cable 58.

The drawn air then passes a first ionization electrode, hereinafter referred to as primary ionizer 26, extending across the inner space of housing 4. Primary ionizer 26 preferably includes a carbon thread electrode operative to charge air particles and bacteria with negative charges when the primary ionizer is electrified by a high voltage source 30 through a connecting wire 23.

The ionized air then passes through a filter 16 which is preferably a metallic electrostatic filter. Filter 16 is preferably a rectangular planar element extending vertically across housing 4 parallel to primary ionizer 26. Filter 16 is preferably mounted laterally to two sides of housing 4 and mounted vertically to a pair of rear facing brackets 20 attached to the bottom surface of housing 4. Brackets 20 are preferably spring loaded so as to touch a surface of filter 16 and are also grounded as will be described in more detail below. The term "ground" should be hereinafter understood to include grounding equivalents such as, for example, connection via high resistance to an AC connection of a wall plug.

The filtered air next passes through a second ionization electrode, hereinafter referred to as secondary ionizer 10, which is mounted on housing 4 parallel to primary ionizer 26 and filter 16. Secondary ionizer 10 is preferably fitted onto the inside surface of a front grill 6. Secondary ionizer 10 preferably includes a carbon thread electrode operative to re-ionize the air with negative ions when the secondary ionizer is electrified by high voltage source 30 through a connection wire which is not shown in the drawings. The re-ionized air then exists housing 4 through front grill 6.

In a preferred embodiment of the invention, high voltage source 30 is connected, preferably through power cable 58, to a wall plug including connections to AC voltage and a connection to ground. Alternatively, the connection of high voltage source 30 to ground can be replaced by a connection, through high resistance (typically around 10 MΩs), to one of the AC connections of the wall plug.

In a preferred embodiment, the supply of AC voltage from power cable 58 to high voltage source 30 and to fan 46 is controlled by an on/off switch 54. On/off switch 54 is preferably located on a control panel 56 which is mounted to the outside surface of housing 4. Control panel 56 may also include other desired controls such as, for example, a fan-speed control for controlling the rate at which air circulates through housing 4.

A preferred embodiment of the present invention further includes a ground return terminal 22 which is conductively mounted to one of brackets 20. Grounding of the interior of the ionization device is preferably provided by a return wire 24 connecting ground return terminal 22 to a ground return of high voltage power supply 30. More preferably, brackets 20 are electrically interconnected by a conducting wire 28, thereby allowing simultaneous grounding through both of brackets 20. The present inventors observed that this internal grounding is sufficient for discharging charges on the outer surface of housing 4 when the humidity in the air is high.

In a preferred embodiment of the invention, however, a high output of ions can be provided by the ionization device, even in low humidity, when the exterior surface 5 of housing 4 is grounded. A grounding wire 36 is preferably connected at one end thereof to ground-return terminal 22, in contact with one of brackets 20, which is grounded through wire 24 as described above. The other end of grounding wire 36 is connected to a grounding lug 40 in contact with exterior surface 5 preferably at the back side of housing 4, as illustrated in FIG. 1. The combination of grounding lug 40 and grounding wire 36 provides a stable electric connection between exterior surface 5 and grounding terminal 22 and, therefore, surface 5 can be discharged steadily regardless of the humidity level surrounding the ionization apparatus.

It should be appreciated that the present invention allows efficient operation of the ionization device even in a very dry environment, wherein the humidity in the air is insufficient for conducting the charges which accumulate on surface 5 directly to grounding terminal 22. It has been found by the present inventors that, in a preferred embodiment of the invention, the relatively small dimensions of lug 40 are sufficient for effective discharge of surface 5. Therefore, no extensions of lug 40 toward different regions of surface 5 are required, contrary to what might have been expected. Experiments have also shown that, even in very dry environments, the area of surface 5 covered by lug 40 may be relatively small.

Figure 3:
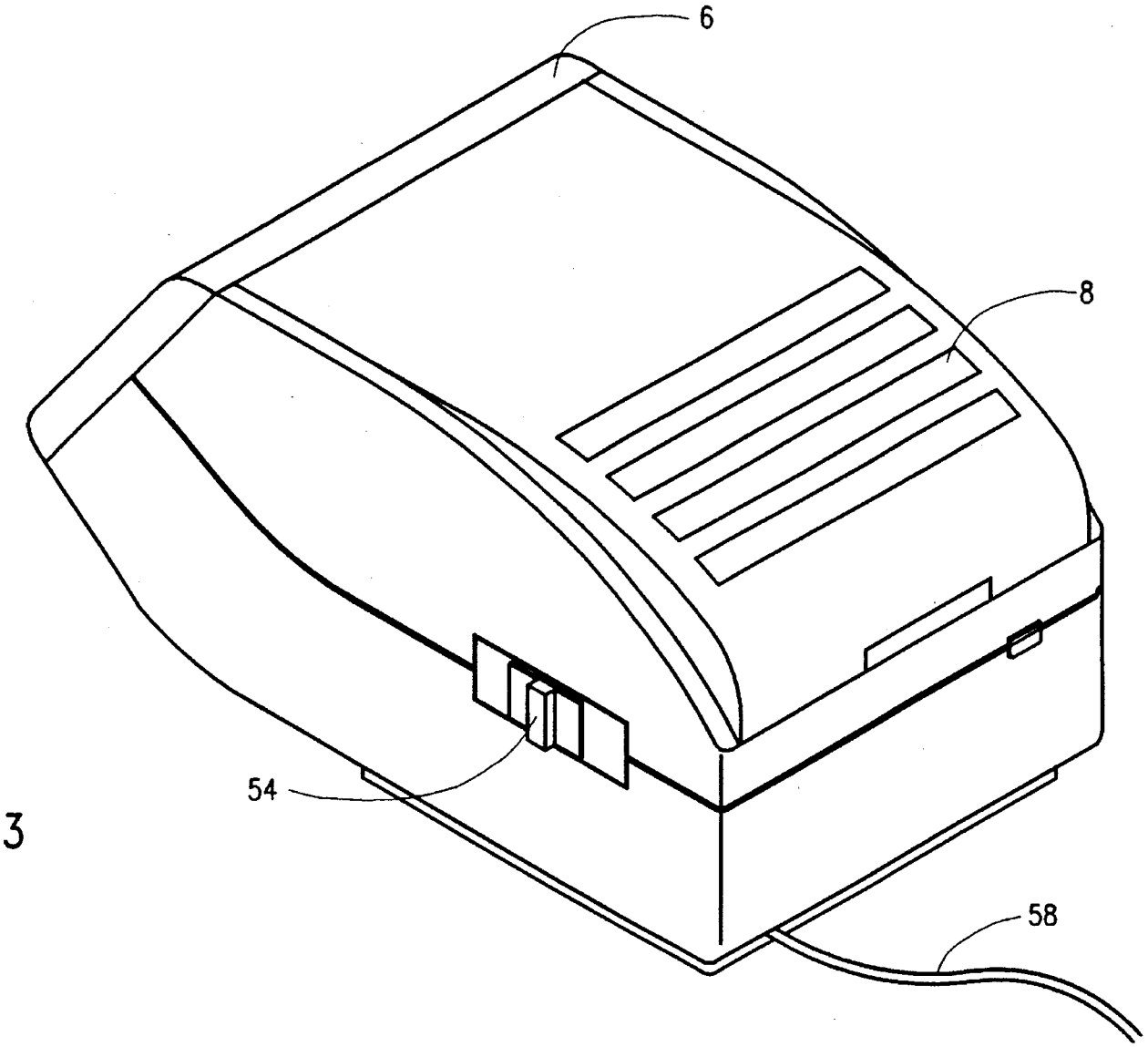
FIG. 3 is a perspective drawing of an ionization device in accordance with another preferred embodiment of the present invention.
Figure 4:
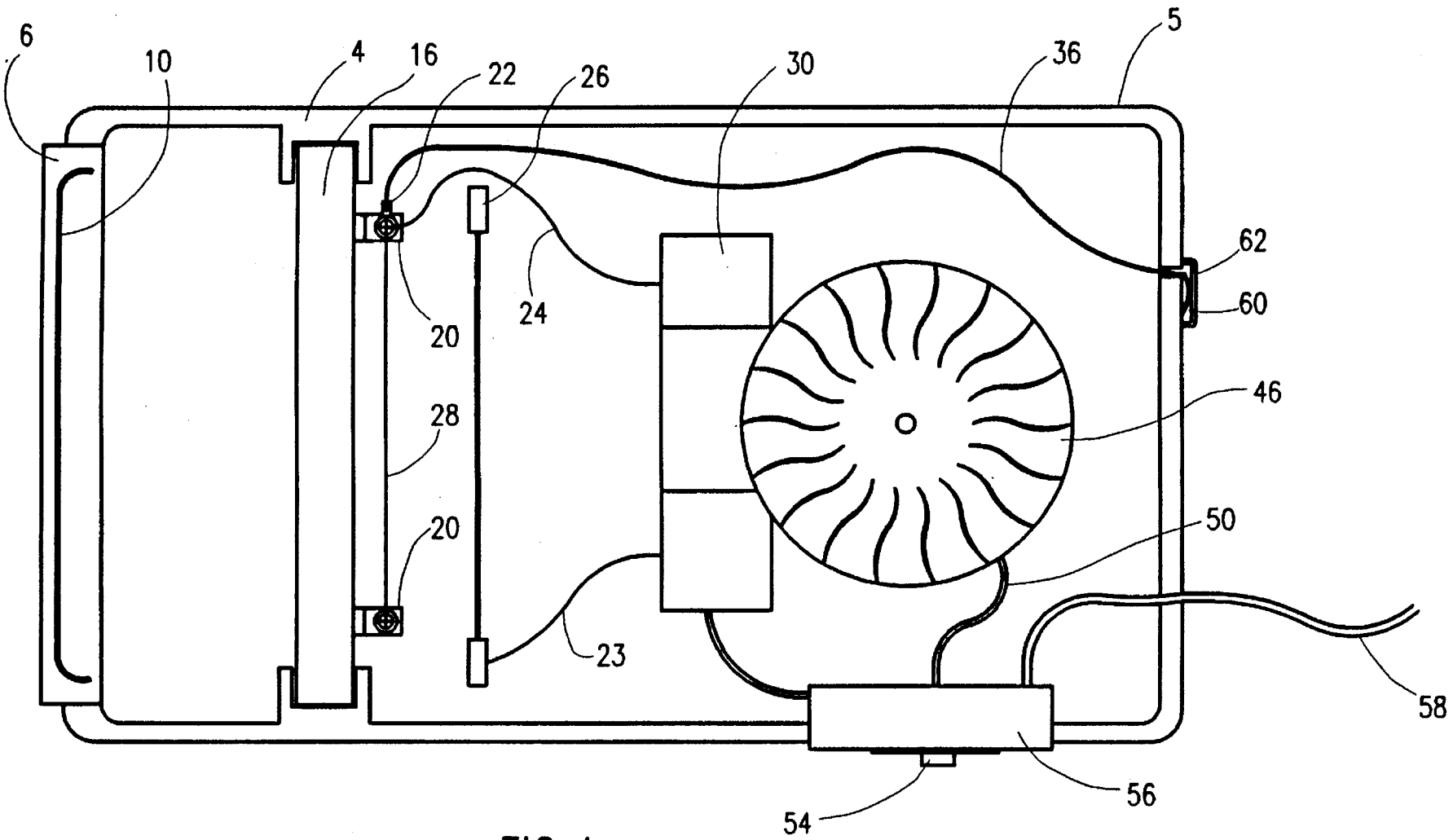
FIG. 4 is a schematic cross-section illustration of the ionization device in FIG. 3.

Reference is now made to FIGS. 3 and 4 which illustrate an ionization device which is substantially identical to that shown in FIGS. 1 & 2 except as specifically mentioned hereinabove. Identical elements are identified by identical reference numerals.

In the embodiment of FIGS. 3 and 4, lug 40 is obviated and instead, an exposed end 60 of grounding wire 36 is located within a recess 62 formed at the back of housing 4. This structure provides efficient grounding of the outside surface 5 of housing 4.

It will be appreciated by persons skilled in the art that the present invention is not limited by what has been described hereinabove. Rather the scope of the present invention is defined only by the following claims:

I claim:

1. Ionization apparatus comprising:

a substantially insulative housing;

a high voltage source having a high voltage terminal and a ground return terminal;

an ionization electrode inside the housing electrically connected to the high voltage terminal; and a grounding wire mounted onto a conductive grounding lug which extends through the substantially insulative housing into contact with the exterior surface of the housing, said grounding wire being electrically connected to the ground return terminal.

2. Apparatus according to claim 1 and further comprising apparatus for circulating air through the housing.

3. Apparatus according to claim 2 wherein the apparatus for circulating air includes an electric fan.

4. Apparatus according to claim 2 and further comprising a filter mounted inside the housing parallel to the ionization electrode and electrically connected to the ground return terminal.

5. Apparatus according to claim 4 wherein the filter is an electrostatic filter.

6. Apparatus according to claim 4 wherein the filter is mounted to at least one conducting bracket and wherein the filter is connected to the ground return terminal through the at least one conducting bracket.

7. Apparatus according to claim 2 and further comprising a secondary ionization element, inside the housing, electrically connected to the high voltage terminal and located near a surface of the housing in a plane parallel to the ionization electrode.

8. Apparatus according to claim 2 and further comprising an internal grounding wire located near the ionization electrode and electrically connected to the ground-return terminal.

9. Apparatus according to claim 2 and also comprising an insulative shield covering the electrical connection between the grounding wire and the exterior surface of the housing.

10. Apparatus according to claim 1 and further comprising a filter mounted inside the housing parallel to the ionization electrode and electrically connected to the ground return terminal.

11. Apparatus according to claim 10 wherein the filter is an electrostatic filter.

12. Apparatus according to claim 10 wherein the filter is mounted to at least one conducting bracket and wherein the filter is connected to the ground return terminal through the at least one conducting bracket.

13. Apparatus according to claim 1 and further comprising a secondary ionization element, inside the housing, electrically connected to the high voltage terminal and located near a surface of the housing in a plane parallel to the ionization electrode.

14. Apparatus according to claim 1 and further comprising an internal grounding wire located near the ionization electrode and electrically connected to the ground-return terminal.

15. Apparatus according to claim 14 and also comprising an insulative shield covering the electrical connection between the grounding wire and the exterior surface of the housing.

16. Apparatus according to claim 1 and also comprising an insulative shield covering the electrical connection between the grounding wire and the exterior surface of the housing.

* * * * *